United States Patent [19]

Fegan

[11] 3,983,592

[45] Oct. 5, 1976

[54] RUG SHAMPOOER

[75] Inventor: Richard M. Fegan, Flemington, N.J.

[73] Assignee: General Signal Corporation, Rochester, N.Y.

[22] Filed: Jan. 20, 1975

[21] Appl. No.: 542,742

Related U.S. Application Data

[62] Division of Ser. No. 384,851, Aug. 1, 1973, Pat. No. 3,875,605.

[52] U.S. Cl. ..... 15/49 R

[51] Int. Cl.[2] ..... A47L 11/03; A47L 11/18

[58] Field of Search ..... 15/49 R, 49 RB, 49 C, 15/50 R, 50 A, 50 C, 51, 52, 98, 361; 51/176

[56] References Cited

UNITED STATES PATENTS

| | | | |
|---|---|---|---|
| 1,576,428 | 3/1926 | Hadwiger | 15/49 C X |
| 2,260,207 | 10/1941 | Berg | 15/361 X |
| 2,329,563 | 9/1943 | Taylor | 15/361 |
| 3,072,940 | 1/1963 | Kelly | 15/49 C |
| 3,422,579 | 1/1969 | Rogge et al. | 51/176 |

FOREIGN PATENTS OR APPLICATIONS

| | | | |
|---|---|---|---|
| 458,176 | 7/1949 | Canada | 15/51 |

*Primary Examiner*—Edward L. Roberts
*Attorney, Agent, or Firm*—Milton E. Kleinman; George W. Killian; John Ohlandt

[57] ABSTRACT

A rug shampooing machine, including means for producing dry foam from a liquid detergent source and for working such foam into a rug or carpet by means of a brush rotating on a horizontal axis; further comprising a vacuum nozzle, roller and squeegee means for picking up the dirty solution resulting from the scrubbing or shampooing action.

A foam generator mechanism is especially adapted to produce the aforesaid foam from the detergent source. This mechanism includes two rollers situated above the scrubbing brush, just below the outlet from the detergent source. The axes of the rollers are in a substantially horizontal plane and parallel to the surface to be cleaned. The rollers are of different diameters, the larger of the two being a foam plastic roller, which is driven by a belt connected to the scrubbing brush. The two rollers are continuously compressed together in order to create the desired foam.

A reverse-stroke brush lift-off mechanism is also incorporated in the rug-shampooing machine. The scrubbing brush, being in contact with the surface to be cleaned, is active in propelling the machine forwardly and is effective in working the foam detergent into the rug. However, on the return stroke, which is a natural stroke that the user would tend to indulge in because it has become a habit in the use of conventional vacuum cleaners, the rotation of the brush would act to interfere with easy return movement. Accordingly, as the user pulls the machine backwardly, the brush is lifted by means of a reaction principle involving very little force.

1 Claim, 9 Drawing Figures

RUG SHAMPOOER

This is a division of application Ser. No. 384,851 filed Aug. 1, 1973, and now U.S. Pat. No. 3,875,605.

BACKGROUND, OBJECTS, AND SUMMARY OF THE INVENTION

The present invention relates to a rug shampooing machine and especially to a rug shampooer which uniquely and efficiently provides for cleaning of rugs and the like with a prefoamed detergent.

A variety of devices of machines for home use in scrubbing and polishing floors, and also in scrubbing or shampooing rugs and carpets, has developed over the past decade or so. The resultant mass production effort attendant these developments has brought about sharp decreases in the cost of the units; hence, they have found a widespread market compared with the commercial units that were available 10 years ago.

A fundamental approach that has been taken in the design of machines for rug cleaning is to provide a unit that is eminently suited to produce the required scrubbing action for cleaning the rug or carpet and at the same time includes a means for vacuuming the dirty water resulting from the scrubbing action. An example of a rug shampooer which provides this assembly of functions is described in U.S. Pat. No. 3,392,418.

It has become an object of the machine described in the aforesaid patent, as well as other machines known in the prior art, to minimize the wetting of the rug in the scrubbing or shampooing operation and thereby to promote efficient cleaning thereof. Accordingly, it becomes necessary to create a foam from the liquid detergent before depositing the detergent on to the rug. It is noteworthy that a properly prepared foam made from a liquid detergent is far less expensive and more effective than dry, powdered materials, which have sometimes been sprinkled on the rug.

It is therefore a fundamental object of the present invention to provide a compact, efficient and economical rug shampooing machine.

A more specific object of the present invention is to provide an efficient foam generating mechanism.

Another object is to provide such a foam generating mechanism so as to avoid the complications entailed when a source of air must be supplied to a manifold in creating such foam.

A primary feature of the present invention resides in the arrangement of a simplified foam generating mechanism which includes two rollers situated above the scrubbing brush just below a detergent source outlet. The two rollers are continuously compressed together in order to create the foam. More specifically, the axes of these rollers are in a substantially horizontal plane and parallel to the surface to be cleaned. The rollers are of different diameters, the larger of the two being a foam plastic roller, which is driven by a belt connected to the scrubbing brush.

Since it is a well known fact that the user of a typical vacuum cleaner device has become accustomed to a forward and reverse stroke, that is to a back and forth movement of the cleaning device, the rug shampooer of the present invention has been designed with this in mind.

Accordingly, it is another major object of the present invention to make the rug shampooing machine operation conform closely to the conventional operation of cleaning devices which are operated by the user with a back and forth movement. In other words, it has been recognized as extremely efficacious to provide a rug shampooing machine which conforms as closely as possible to this preconditioned mode of operation. However it becomes desirable, as will be apparent, that the scrubbing action on the carpet or rug will take place only during the forward stroke or forward movement of the machine and not during the return stroke.

It is therefore another object of the present invention to provide a mechanism which will produce lift-off of the brush from the surface to be cleaned when the machine is in its reverse stroke or backward movement.

Yet another object is to incorporate the lift-off mechanism such that it automatically operates on the return stroke to lift off the brush.

The above cited objects and purposes relating to brush lift-off are accomplished by the mechanism of the present invention which works upon a reaction principle and involves very little force in the operation. In effect, there is no conscious manipulation of any part by the operator in order to bring about the brush lift-off. Rather, by simply pulling the machine backwardly, which is an accustomed action, the reaction principle is effectuated. Specifically, the brush lift-off mechanism comprises a linkage system connected to the handle and suitably pivoted to the base or housing of the rug shampooing machine such that the inertia of the machine on the rug creates enough reaction to operate the linkage with no effect on the operator. Moreover, when the return stroke is finished the brush, and concomittantly if desired, the vacuum pick-up, are automatically dropped down and assume their original positions.

Further objects, features and advantages of the present invention will be appreciated as the description of the invention in the following specification proceeds, such description being taken in connection with the accompanying drawing.

DESCRIPTION OF PREFERRED EMBODIMENT

Figure 1:
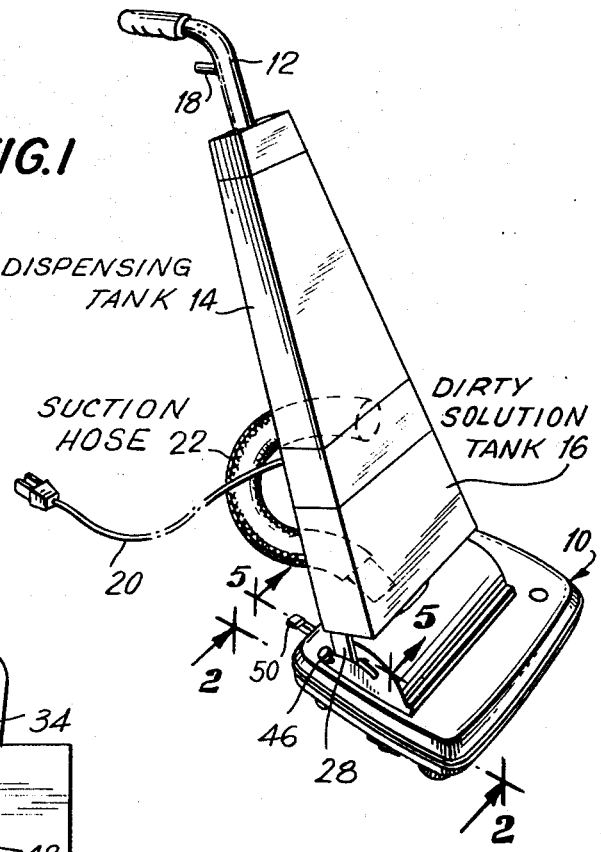
FIG. 1 is a perspective view of a rug shampooer embodying the concepts of the present invention.
Figure 4:
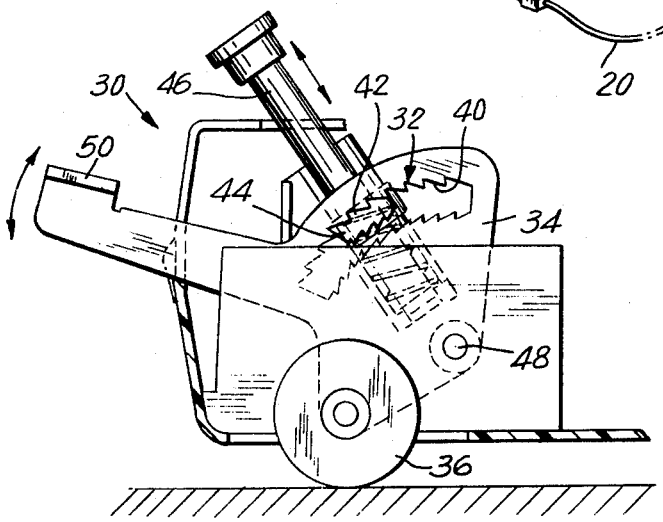
FIG. 4 is a fragmentary view of the rear of the rug shampooer, illustrating a mechanism for adjusting the height of the rear of the machine from the surface to be cleaned.

Referring now to the drawing and particularly to FIG. 1 thereof, a rug shampooer embodying the concepts of the present invention is illustrated. The rug shampooer comprises a base or lower housing 10 and a handle 12. Mounted on the handle are an upper dispensing tank or container 14 for dispensing liquid detergent and a lower tank 16 for storing the dirty solution as it is vacuumed from the surface being cleaned. At the upper end of the handle 12, there is provided a valve actuating device 18 for controlling the dispensing of the liquid detergent from tank 14. A conventional power cord 20 is provided for supplying power to the shampooer, and a suction hose 22 will be seen at the rear of the machine for conveying the dirty solution to the tank 16.

Figure 2:
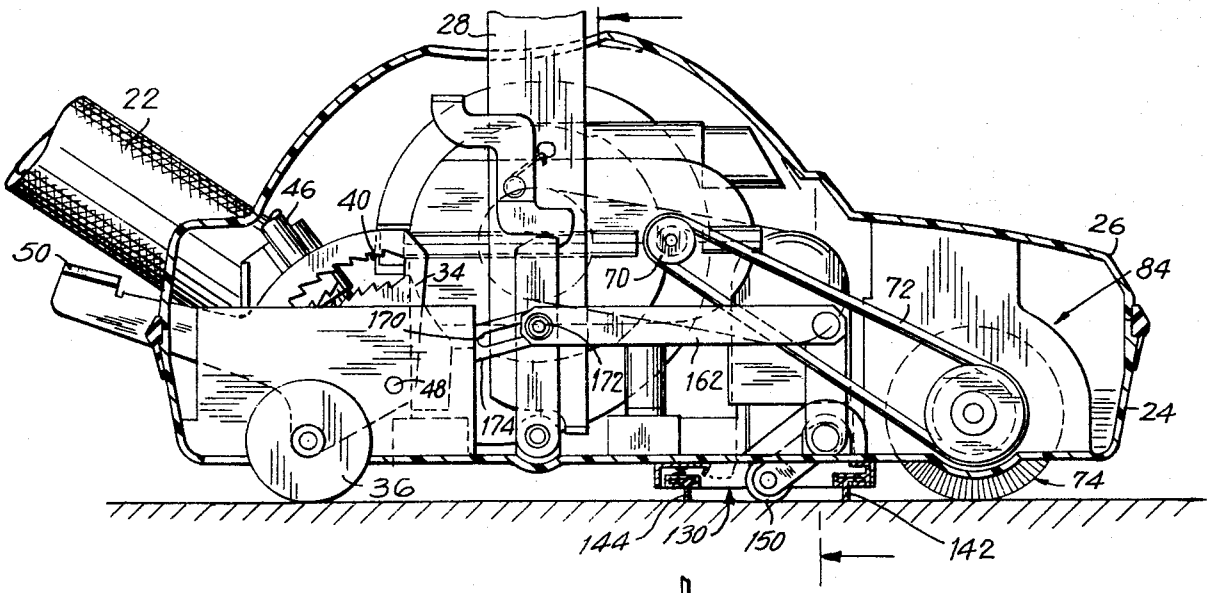
FIG. 2 is a vertical sectional view taken on the line 2—2 of FIG. 1.

The lower housing or base 10 is made up of a dishshaped frame 24 and a cover 26 (see especially FIG. 2). The handle is suitably bifurcated as it extends downwardly to define the yoke members 28, such yoke members being connected in a manner hereinafter described.

At the rear of the housing 10 there will be seen a mechanism 30 for adjusting the height of the housing 10 above the surface to be cleaned, thereby to affect the elevation of the brush and nozzle of the rug shampooer with respect to that surface. Such mechanism per se is conventional in the art and includes a ratchet-escapement 32 and a pivotable bracket 34 which carries a wheel 36. A corresponding wheel 36 is located at the other side of the machine. The pivotable bracket 34 is provided with ratchet teeth 40 which cooperate with similar teeth 42 on a pawl 44 carried by a spring biased rod 46. The bracket 34 is adapted to be pivoted about the pin 48. An integral lever 50 on the bracket is used to raise the rear end of the machine in steps, as is well known, while the rod 46 functions to lower it in corresponding steps, such being accomplished by the respective lowering and raising of the two wheels 36 in response to actuation of the aforesaid lever and rod.

Figure 3:
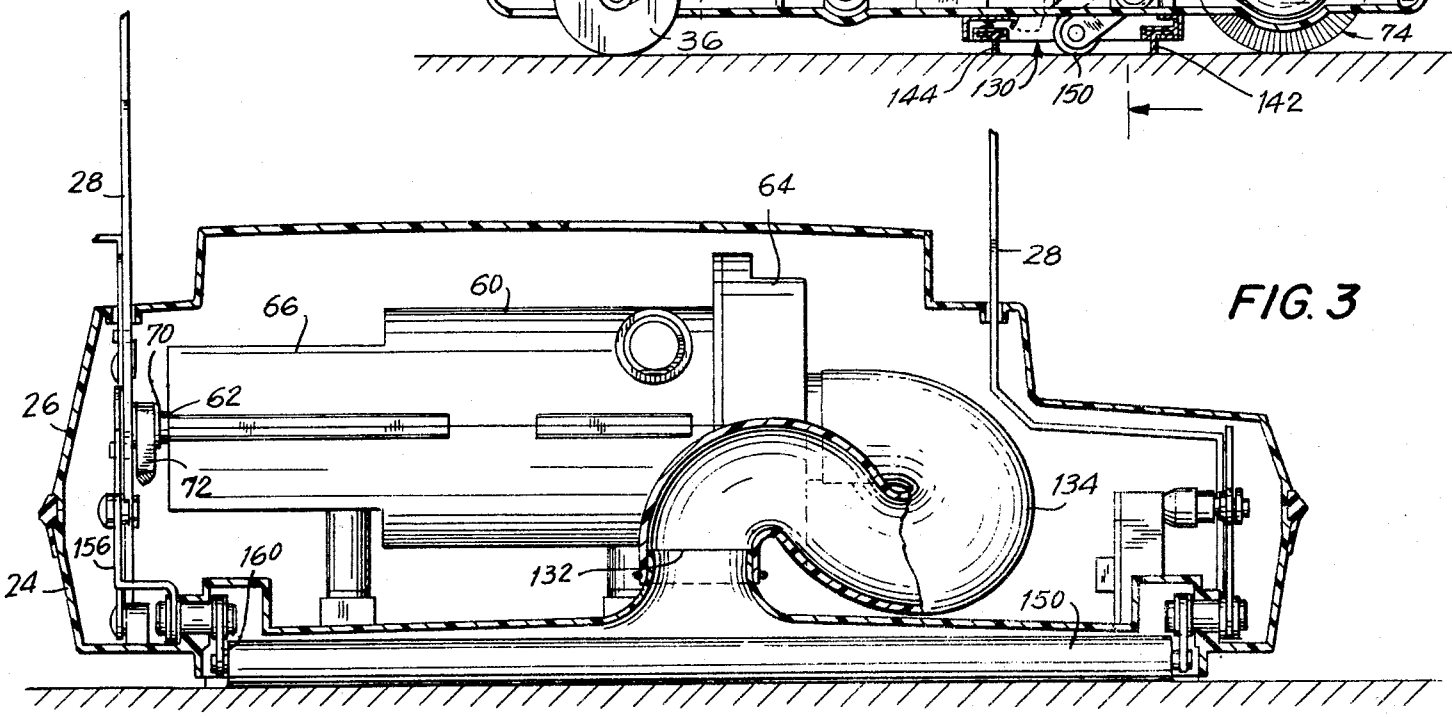
FIG. 3 is a vertical sectional view taken on the line 3—3 of FIG. 2.
Figure 8:
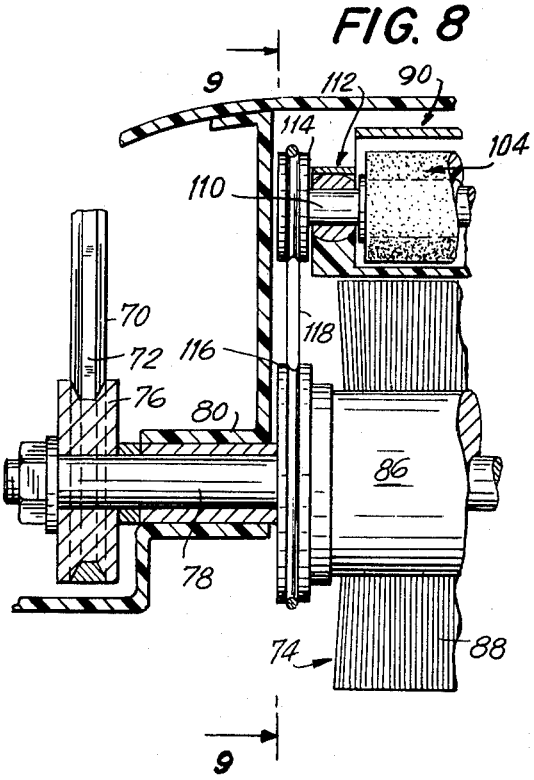
FIG. 8 is a fragmentary view illustrating the drive for the brush and foam generator mechanism.
Figure 9:
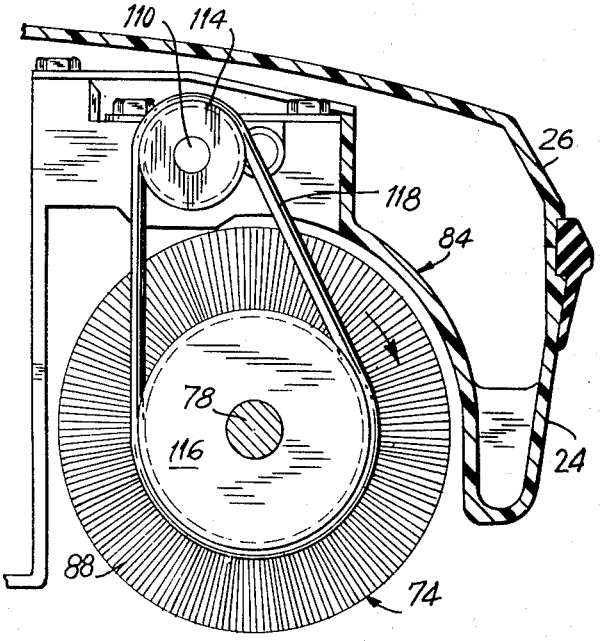
FIG. 9 is a vertical section taken on the line 9—9 of FIG. 8.

Within the housing 10, there is mounted a motor 60, the drive shaft 62 of which carries and rotates a vacuum fan 64, seen on the right in FIG. 3, and a motor-cooling blower 66, seen on the left in the same figure. The shaft 62 is also effective to drive a pulley 70, also on the left, which in turn drives belt 72, thereby to drive a cleaning brush 74 by way of pulley 76 fixed to shaft 78 (FIG. 8).

The cleaning brush 74 extends transversely with respect to the front of the machine and is suitably journaled in bushings 80 and 82 at opposite sides thereof. A shroud 84 surrounds and partially encloses the cleaning brush 74. It will be noted that the brush consists of a core roller 86, typically constructed of stainless steel or the like, on which are mounted bristles 88.

Figure 6:
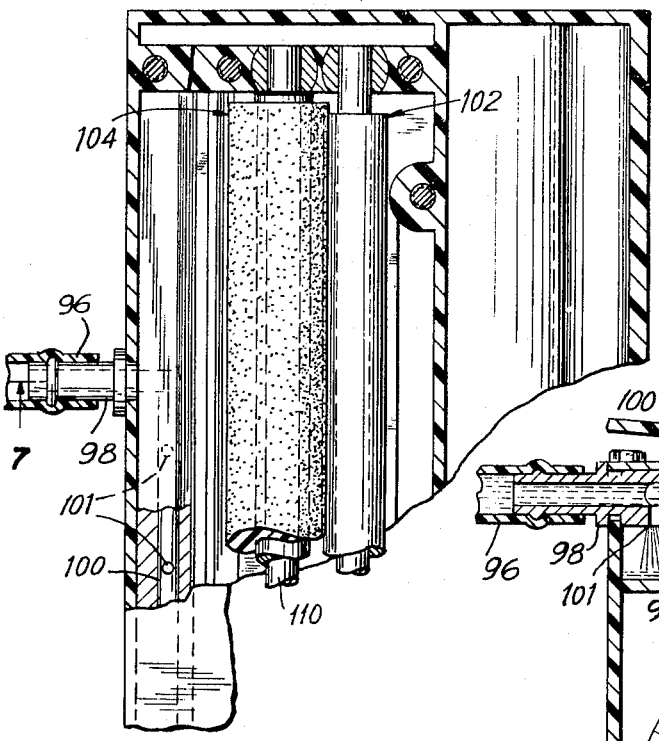
FIG. 6 is a fragmentary plan view illustrating the foam generator mechanism of the present invention.

In accordance with a primary feature of the present invention, a form generator mechanism 90 is judiciously arranged and disposed in cooperative relationship with the cleaning brush 74. This mechanism is capable of producing abundant quantities of dry foam in an efficient manner. As can be especially appreciated by reference to FIG. 7, the foam generator mechanism is located immediately above the cleaning brush 74 in a housing 92; the housing being especially constructed so that a reservoir or well 94 for liquid detergent is provided in its lower wall. Such detergent is supplied from the dispensing tank 14 by operation of the actuating device 18 which affects a valve in a conventional manner to produce flow of detergent from the tank 14. The detergent is transmitted by means of the hose 96 at the rear of the foam generator mechanism, such hose being fitted over a nipple 98. The nipple in turn is connected to a distribution pipe 100 which extends transversely of the foam generator housing 92 (FIG. 6), the pipe 100 having a series of apertures 101 spaced along its transverse extent.

It will be seen that the foam generator includes a pair of rotatable rollers 102 and 104. The roller 102 is of solid steel construction, whereas the roller 104 consists of a core 106 of stainless steel or the like on which is mounted a foam plastic cover 108. It will be seen that the axes of the rollers 102 and 104 are in a substantially horizontal plane and parallel to the surface to be cleaned. The roller 104 has a much larger outside diameter than has roller 102, it having been found that this is an extremely efficient construction for the rollers. The cover 108 is preferably constituted of a foam plastic material such as polyurethane which is adaptable to be readily flexed when the peripheries of the rollers 102 and 104 are brought into pressure contact.

The roller 104 is affixed to a shaft 110 which is journaled in the bearings 112 at the end of the housing 92. The shaft 110 extends beyond the housing and is fitted with a pulley 114. The shaft 78 which supports the brush core 86 is fitted with a pulley 116, and a driving connection between the two pulleys 114 and 116 is established by means of a belt 118. It will thus be appreciated that the driving connection between the motor 60 and the brush 74 by way of the appropriate pulleys and belt, will also serve to transmit movement to the foam plastic roller 104.

It will be apparent, especially by reference to FIG. 6–9, that liquid detergent stored in the dispensing tank 14 is fed to the foam generator mechanism 90 via the tubing 96 and the nipple or pipe 98. The liquid detergent is discharged into the foam generator mechanism through the apertures in the distribution tube or pipe 100 so that the liquid detergent becomes evenly distributed along the transverse extent of the housing.

Figure 7:
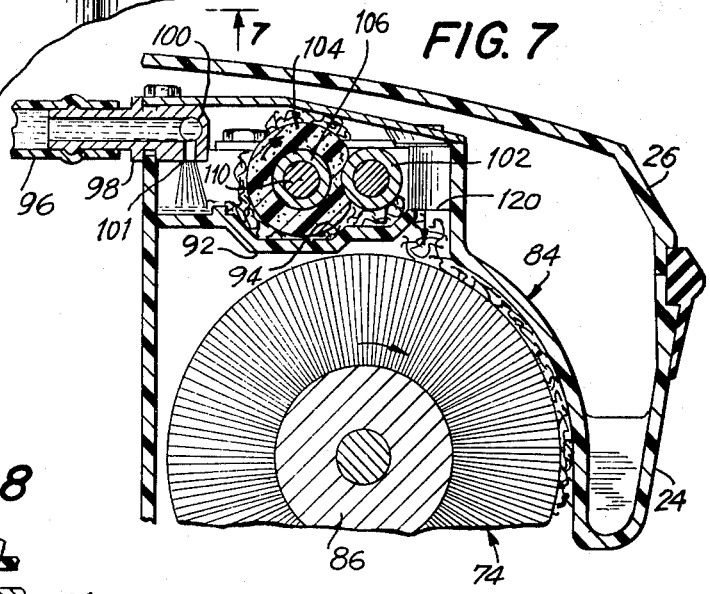
FIG. 7 is a sectional view taken on the line 7—7 of FIG. 6, particularly illustrating the relationship between the foam generator mechanism and the cleaning brush of the rug shampooer.

It will be seen, by reference to FIG. 7, that as a result of the well 94 formed in the lower wall of the housing 92 of the foam generator mechanism, the incoming liquid detergent will collect therein and thence be taken up by the foam roller 104. It will also be seen that the foam roller 104 is in constant peripheral flexing contact with the rigid roller 102 and hence that this flexing action of the foam plastic material of the roller 104 will serve to aerate the detergent and generate the required dry foam. An opening, or series of openings 120, is provided at the front of the housing 92.

It will be understood that in the operation of the foam generator mechanism it is preferable that the amount of liquid detergent permitted to flow down into the housing of the foam generator 90 be regulated such that the liquid detergent just fills the well 94. However, such an objective is not critical and the detergent can be permitted to rise to a somewhat higher point.

It will be apparent from the preceding description that, upon energization of the rug shampooer, the brush 74, because of suitable reduction gearing, will rotate slowly in the clockwise direction as viewed in FIG. 7. The plastic foam roller 104 is likewise driven in a clockwise direction because of the belt connection 118. The dry foam, which has been generated by the aforenoted flexing action of the foam plastic roller against the steel roller 102, is efficiently moved forwardly and down through the openings 120 whence it falls onto the bristles of the brush 74 and is thereby carried by the bristles so as to be deposited on the rug being cleaned. Since the brush 74 acts to propel the machine forwardly the aerated, essentially dry, foam is deposited on successive areas of the rug and is worked into the nap of the rug. The detergent foam of course acts to pick up the dirt in the rug as a result of the thorough scrubbing of a given area. The foam with the entrained or collected dirt is then removed from the rug or other surface. This is accomplished by a vacuuming and squeegeeing operation to be described.

Vacuuming of the dirty foam is achieved by apparatus including nozzle 130, which is of conventional construction and extends transversely to the direction of movement of the machine, being provided with an upper outlet 132 that communicates with suction hose 134 (FIG. 3), the upper end of which is connected to vacuum fan 64.

The vacuum cleaning operation is performed both in the forward stroke and reverse stroke directions, As a result of the placement of the nozzle 130, it is effective to pick up the foam resulting from the scrubbing operation. Also, a squeegee assembly 140 is associated with the nozzle 130. This squeegee assembly, which can be removed as desired, is preferably floatably mounted to the frame 24 and is spring biased to permit it to conform to minor variations in the contour of the particular rug being scrubbed as well as to various settings of the height adjustment mechanism 30. The assembly includes two wipers 142 and 144 which extend transversely, roughtly to the same extent as the forward roller to be described. Variable adjustment with respect to the two directions of movement of the machine can be accommodated by mounting the squeegee assembly in such a way that the assembly floats upwardly and offers little resistance during the forward stroke, but the squeegee assembly is pushed downwardly onto a floor during a reverse stroke motion, at that time providing an increased squeezing action so as to remove dirty foam.

Figure 5:
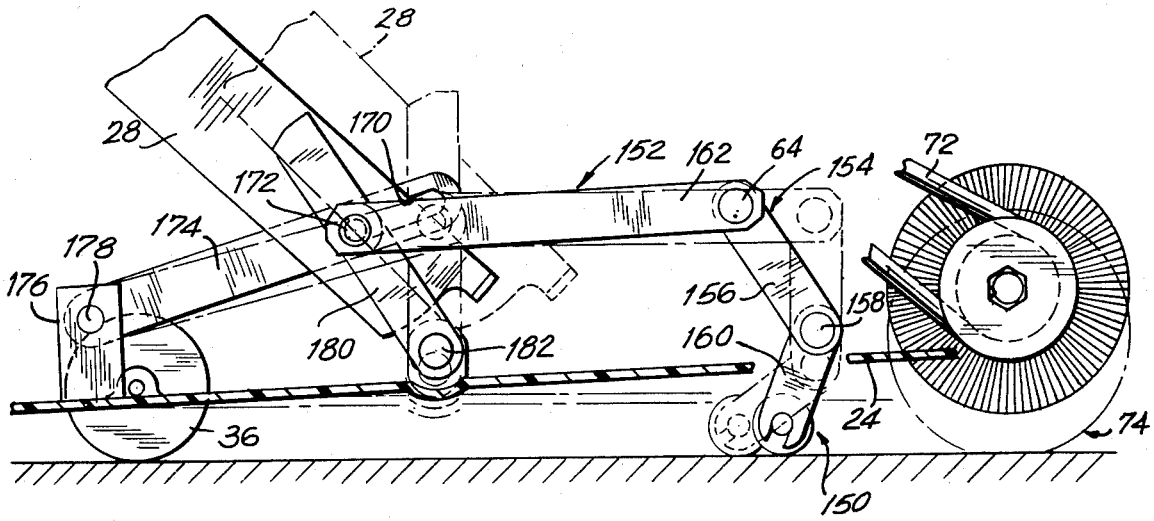
FIG. 5 is a diagrammatic view illustrating the brush lift-off mechanism of the present invention, the different positions in the operation of the mechanism, as well as the affected parts, being shown in full and in dotted lines.

The reverse stroke mechanism for providing lift off of the brush 74 in response to backward movement of the rug shampooer may best be appreciated by reference to FIG. 5 of the drawing. This view is diagrammatic with certain parts not shown for clarity of illustration. It will be seen that the rear wheels 36 are relatively conventionally mounted. That is, they can be raised or lowered by the height adjustment mechanism 30. However, it is at the forward end of the machine that the mechanism of the present invention is mainly operative. Thus, there will be seen a front roller 150 which is so arranged that it can be placed in two significantly different operative positions by dint of the operation of a linkage system generally designated 152. The normal position, that is to say, the position of the roller and linkage which corresponds to forward movement or to the foward stroke for the machine, is shown by phantom lines. The brush 74 is also shown in its normal position by means of phantom lines.

The linkage system 152 comprises a bell crank 154 having an arm 156 secured to a shaft 158 which is fixed in the frame 24. Another arm 160 is likewise secured to the shaft 158. It will be understood that corresponding structure is provided at the opposite side of the machine (see FIG. 3). A link 162 is pivotally connected by the pin 64 to arm 156. The other end of link 162 is connected by means of a lost motion connection, including slot 170 and pin 172, to a link 174 which in turn is connected to a bracket 176 by means of pin 178.

Link 174 is free to turn about the pivot pin 172 and likewise an additional link 180 is connected at its lower end for pivotal movement by means of the pin 182 secured to the frame 24.

It will be seen that the yoke portions 28 of the handle 12 are pivotally connected by means of the pivot pin 172 to the linkage system 152. Referring now to FIG. 2 it will be understood that in the inoperative position, i.e., when the machine is not being utilized, the yoke 28 of the handle will be in the completely upright or vertical position such that the roller 150 will be in the position illustrated in FIG. 2. Likewise, when the yoke 28 is as shown in the phantom line position in FIG. 5, that is, when the machine is being moved forwardly, or is in the forward stroke, the roller 150 remains in the same position as in FIG. 2. However, when force is exerted upon the handle in the conventional reverse stroke movement by the user of the machine, movement of the handle, and consequently, movement of the yoke portions 28 results in shifting the roller 150 to its solid-line position whereby, also shown by solid lines for the brush 74, the brush is lifted off the surface being cleaned so that its rotation will not interfere with the desired reverse movement for the machine.

The desired position for the roller 150 in response to return stroke operation is achieved by reason of the reaction principle at work with the linkage system 152. That is to say, because of the inertia of the machine on the surface, there is enough reaction to operate the linkage immediately upon the operator pulling back on the handle 12 so as to move the yoke portions 28, and hence the pins 172, within the slots 170. This automatically and immediately produces movement of the link 162 in the rearward direction which in turn causes the arm 156 of the bell crank 154 to be rotated and hence produces rotation of the arm 160 thereof. Consequently, the roller 150 is forced downwardly against the surface being cleaned. The final result is that the forward part of the machine is raised and hence the brush is lifted off the surface.

While there has been shown and described what is considered at present to be the preferred embodiment of the several features of the present invention, it will be appreciated by those skilled in the art that modifications of such features may be made. Accordingly, it is desired that the invention not be limited to this embodiment, and it is intended to cover in the appended claims all such modifications as fall within the true spirit and scope of the invention.

What is claimed is:

1. A rug treating machine comprising:

1. a motor;

2. a brush rotatably driven about a horizontal axis by said motor, said brush being adapted to urge propulsion of said machine forwardly, when said brush is in contact with a surface to be cleaned;

3. a forward roller and a rearward roller for supporting the front and rear of said machine, respectively;

4. a control handle for guiding the movement of said machine and coupled to said machine and to one of said rollers by a linkage including a lost motion connection; and wherein

5. in response to rearward translational movement of said machine by manual manipulation of said control handle said one of said rollers is moved by said linkage in a direction to lift said brush from said surface and terminate the effectiveness of said brush for urging forward propulsion of said machine.

* * * * *